US008672822B2

(12) United States Patent
Walsh et al.

(10) Patent No.: US 8,672,822 B2
(45) Date of Patent: Mar. 18, 2014

(54) CARTON, CARTON BLANK AND ASSOCIATED METHODOLOGY

(75) Inventors: Joseph C. Walsh, Boulder, CO (US); Robert L. Conatser, Golden, CO (US)

(73) Assignee: Graphic Packaging International, Inc., Marietta, GA (US)

( * ) Notice: Subject to any disclaimer, the term of this patent is extended or adjusted under 35 U.S.C. 154(b) by 931 days.

(21) Appl. No.: 12/250,145

(22) Filed: Oct. 13, 2008

(65) Prior Publication Data

US 2009/0036285 A1 Feb. 5, 2009

Related U.S. Application Data

(63) Continuation of application No. 10/957,941, filed on Oct. 4, 2004, now Pat. No. 7,494,044.

(60) Provisional application No. 60/575,212, filed on May 28, 2004.

(51) Int. Cl.
*B31B 1/72* (2006.01)

(52) U.S. Cl.
USPC ..... 493/89; 493/93; 493/95; 493/96; 493/160; 493/183

(58) Field of Classification Search
USPC ..... 493/84, 89, 93–97, 110, 160, 162, 183
See application file for complete search history.

(56) References Cited

U.S. PATENT DOCUMENTS

| | | | | |
|---|---|---|---|---|
| 1,534,007 | A | | 4/1925 | Labombarde |
| 1,867,220 | A | | 7/1932 | Hartmann |
| 1,908,291 | A | | 5/1933 | Goss |
| 2,202,496 | A | | 5/1940 | La Bombard |
| 2,407,802 | A | | 9/1946 | Stotter |
| 2,558,918 | A | * | 7/1951 | Zinn, Jr. ..... 229/164.2 |
| 3,291,372 | A | | 12/1966 | Saidel |
| 4,693,413 | A | | 9/1987 | McFarland et al. |
| 4,733,916 | A | | 3/1988 | Seufert |
| 4,871,345 | A | * | 10/1989 | Wosaba et al. ..... 493/59 |
| 5,551,938 | A | * | 9/1996 | Stone ..... 493/96 |
| 5,694,746 | A | * | 12/1997 | Chung et al. ..... 53/456 |
| 5,794,812 | A | | 8/1998 | Walsh |
| 6,015,084 | A | | 1/2000 | Mathieu et al. |
| 6,773,790 | B2 | | 8/2004 | Lasson |

OTHER PUBLICATIONS

Consolidated International Corporation, Chicago, IL, Consolidated Window Patch Gluing and Lining Machine.
Kohmann GmbH & Co., KG, Mettmann, Window Patching and Lining Machines for Cartons.
International Paper Box Machine Co., Triple A Window Patch Gluing and Lining Machine.

* cited by examiner

*Primary Examiner* — Christopher Harmon
(74) *Attorney, Agent, or Firm* — Womble Carlyle Sandridge & Rice, LLP

(57) ABSTRACT

A carton blank may be formed having at least one score line therein. A second layer of material may overlay at least a portion of the first layer, including the score line, thus defining an overlaid score area. The overlaid score area may include at least a portion in which the second layer is not adhered to the first layer.

6 Claims, 9 Drawing Sheets

CARTON, CARTON BLANK AND ASSOCIATED METHODOLOGY

CROSS-REFERENCE TO RELATED APPLICATION

This application is a continuation of U.S. Nonprovisional application Ser. No. 10/957,941, filed Oct. 4, 2004, which claims the benefit of U.S. Provisional Application No. 60/575,212, the entire contents being hereby incorporated by reference as if repeated in its entirety.

BACKGROUND

Products are commonly packaged in boxes, containers or cartons which may, for example, be formed from a paperboard material. Examples of such boxes, containers or cartons include cereal boxes, milk cartons, butter and margarine boxes and beer and soft drink secondary packaging (e.g., cartons enclosing a plurality of beer or soft drink cans or bottles). For explanatory purposes, the simple term "carton" may be used throughout this description to refer to the general type of boxes, containers or cartons described above.

A carton generally begins as a carton blank which is generally formed from a sheet of paperboard, although other materials are sometimes used. A carton blank will typically include various score lines about which the blank is to be folded, according to the desired configuration of the carton to be formed from the blank. After a carton blank is formed, it is often converted into a "knocked-down" carton. To form the knocked-down carton, the carton blank is typically folded about some, but not all of its score lines in such a way that, although it is partially formed, it still maintains a substantially flat configuration. This flat configuration facilitates space-efficient storage and/or transport of the knocked-down cartons prior to being filled with product.

A knocked-down carton is generally fed into machinery (usually a product filling machine) that opens the knocked-down carton from its flat configuration into what is commonly referred to an "erected carton". In general terms, the filling machine then fills the erected carton with product and then completely seals the carton into a finished package ready for shipment and consumption.

Carton filling operations are typically carried out on high-speed automated machinery. As noted above, one of the first operations performed by this machinery is to open the knocked-down carton into an erected carton to facilitate introduction of product. This opening, in turn, involves the application of an "opening force" to the knocked-down carton for a given period of time. The period of time available depends upon the filling machine configuration and the speed at which the machine is being operated. The opening force applied by the filling machine causes the knocked-down carton to fold about various pre-scored fold lines. In the case of a carton having a rectangular cross-section, for example, erecting the knocked-down carton would require simultaneous folding about four parallel fold lines.

All knocked-down cartons exhibit some resistance to opening. This resistance is primarily associated with the energy required to fold the carton about the fold lines discussed above. If the opening resistance of a carton is too high, the knocked-down carton may fail to open properly when the opening force is applied by the filling machinery. This in turn, can cause the filling machine to jam and, thus, interfere with proper operation.

Some carton blanks are formed having a first (typically) paperboard layer and a second much thinner layer adhered thereto. The inner layer may, for example, be a paper material treated to be substantially impermeable to water and air (e.g., wax impregnated or laminated with plastic). In this manner, the inner layer can function as a liner and provide upper and lower flap portions such that it simulates a "bag-in-box" configuration. The outer layer is typically provided with scored fold lines to facilitate eventual transfiguration of the carton blank into a carton as generally discussed above. This type of carton blank is then typically converted into a knocked-down carton and, eventually, erected and filled, e.g., in a filling machine, in a manner as described above.

SUMMARY

A carton blank is disclosed having a first layer of material with at least one score line therein. A second layer of material may overlay at least a portion of the first layer of material. At least a portion of the second layer of material may be adhered to at least a portion of the first layer of material and a portion of the second layer of material may overlay at least a portion of the at least one score line, thereby defining an overlaid score area. The overlaid score area may include at least an overlaid score area adhered portion and an overlaid score area non-adhered portion. The second layer of material is adhered to the first layer of material in the overlaid score area adhered portion but is not adhered to the first layer of material in the overlaid score area non-adhered portion.

Further disclosed is a carton blank having a first layer of material with at least one score line formed therein, the first layer of material having a first thickness. A second layer of material overlays at least a portion of the first layer of material. The second layer of material may have a second thickness that is less than the first thickness. At least a portion of the second layer of material may be adhered to at least a portion of the first layer of material. A portion of the second layer of material may overlay at least a portion of the at least one score line, thereby defining an overlaid score area. The overlaid score area may include at least one non-adhered portion in which the second layer of material is not adhered to the first layer of material.

Further disclosed herein is a method of making a carton. The method may include forming a first layer having at least one score line therein. The method may further include overlaying at least a portion of a second layer of material with at least a portion of the at least one score line, thereby defining an overlaid score area. The overlaid score area further defines at least one adhered portion and at least one non-adhered portion thereof. The method further includes adhering at least a portion of the second layer of material to the adhered portion but not to the non-adhered portion folding the first layer and the second layer of material about the at least one score line.

Also disclosed herein is a carton having a first layer of material with at least one score line formed therein. A second layer of material may be superposed over at least a portion of the first layer of material. At least a portion of the second layer of material may be adhered to at least a portion of the first layer of material. A portion of the second layer of material may overlay at least a portion of the at least one score line, thereby defining an overlaid score area. The overlaid score area may include at least an overlaid score area adhered portion and an overlaid score area non-adhered portion. The second layer of material is adhered to the first layer of material in the overlaid score area adhered portion but is not adhered to the first layer of material in the overlaid score area non-adhered portion.

DETAILED DESCRIPTION

Figure 1:
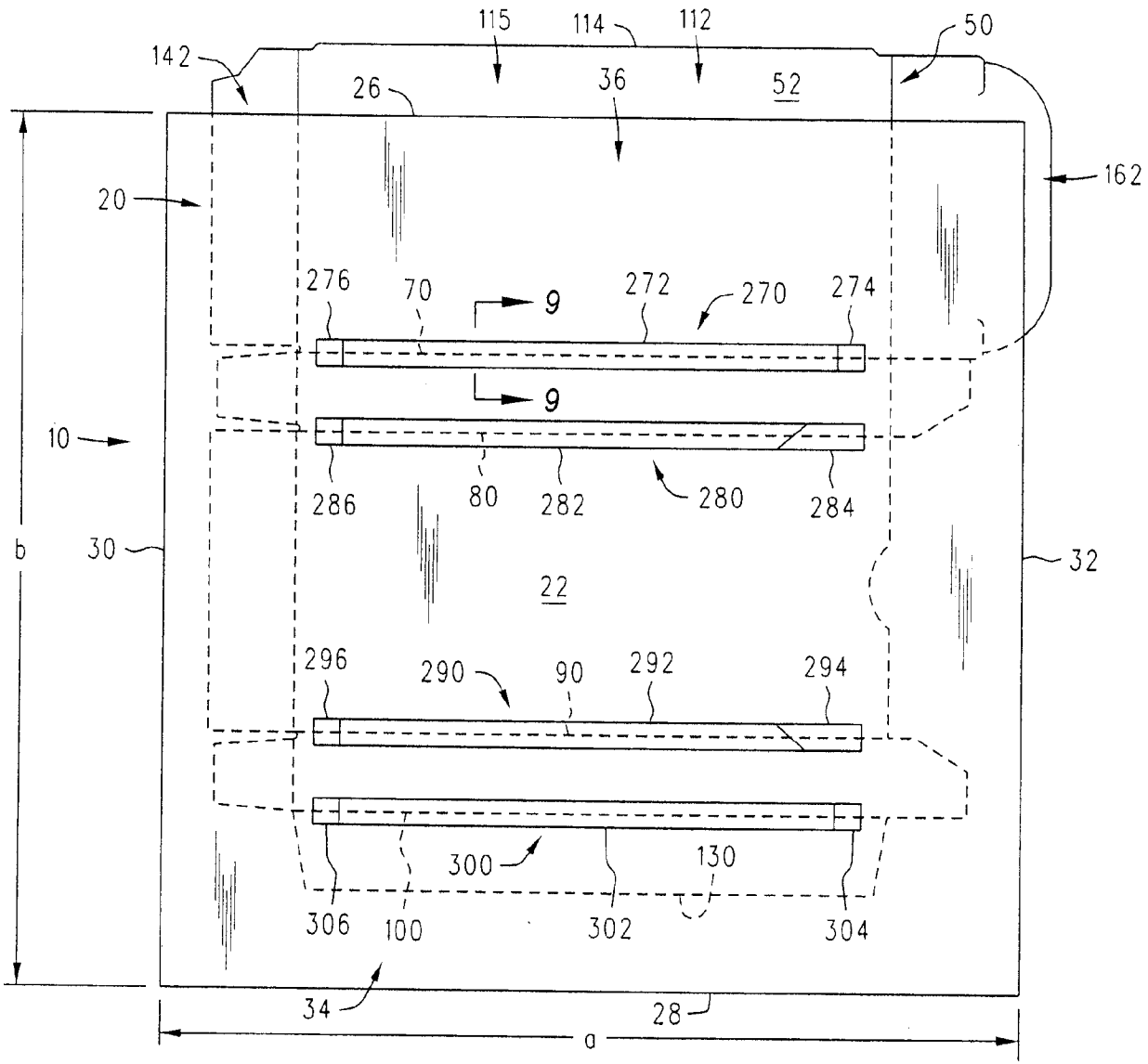
FIG. 1 is a plan view of a carton blank having an inner layer adhered to an outer layer.

FIG. 1 illustrates a carton blank 10 viewed from the inner surface thereof. Carton blank 10 may, for example, have a two layer structure including an inner layer 20 and an outer layer 50. Inner layer 20 may overlay at least a portion of the outer layer 50, as shown, and may be adhered thereto in a manner as will be explained in further detail herein. In general terms, outer layer 50 may, for example, be formed from a layer of paperboard material while inner layer 20 may be formed from a relatively much thinner layer of paper-like material. As will become apparent from the description presented hereinbelow, the use of a two layer carton blank 10 eliminates the need for a separate bag being inserted during eventual product filling.

With further reference to FIG. 1, inner layer 20 may, for example, have a generally rectangular configuration having a first pair of substantially parallel opposing edges 26, 28 and a second pair of substantially parallel opposing edges 30, 32 perpendicular to the first pair of edges 26, 28. In the exemplary embodiment illustrated, inner layer 20 may have a width "a" of about 5.62 inches extending between the edges 30, 32 and a length "b" of about 5.8125 inches extending between the edges 26, 28. Inner layer 20 may, for example, be formed from a layer of material with barrier properties, e.g., a plastic-coated paper material having a thickness, for example, of for about 0.002 inch to about 0.008 inch. Inner layer 20 has an inner surface 22 and an oppositely disposed outer surface 24 (outer surface 24 is shown, for example, in FIGS. 3 and 4, in which the carton blank has been formed into a knocked-down carton).

Figure 2:
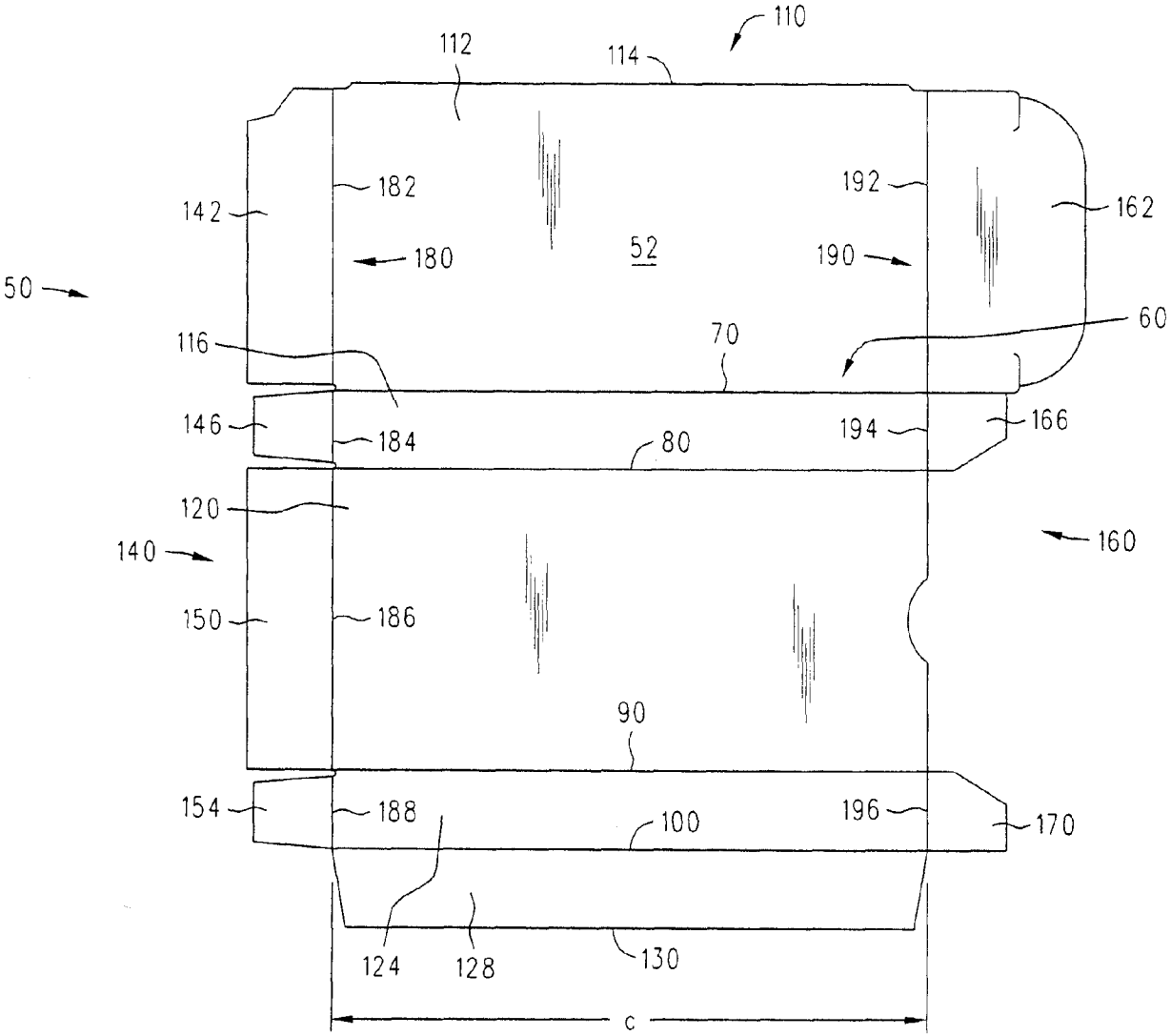
FIG. 2 is a plan view of the outer layer of the carton blank of FIG. 1.

FIG. 2 illustrates the outer layer 50 in further detail, with the inner layer 20 removed for clarity. Outer layer 50 may, for example, be formed from a layer of paperboard material having a thickness, for example, of from about 0.010 inch to about 0.020 inch. With reference now to FIG. 2, outer layer 50 may include an inner surface 52 and an oppositely disposed outer surface 54 (outer surface 54 is shown, for example, in FIGS. 3 and 4, in which the carton blank has been formed into a knocked-down carton). As can be appreciated, outer surface 54 will be on the exterior of the carton eventually formed from the carton blank 10. Accordingly, the outer layer outer surface 54 will typically include appropriate graphics (e.g., printed text and/or images) associated with the product to be packaged within the carton in a conventional manner.

Figure 9:
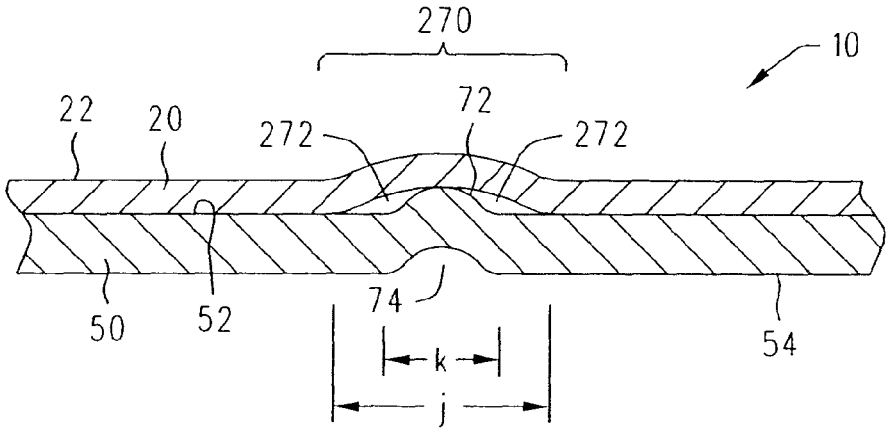
FIG. 9 is a partial cross-sectional view taken along the line 9-9 of FIG. 1 and showing, in greater detail, one of the score lines of the carton blank of FIG. 1.

With continued reference to FIG. 2, outer layer 50 may include a plurality of substantially parallel scored fold lines 60, such as the individual score lines 70, 80, 90, 100. The score lines 60 may be formed in any conventional manner, for example, by using a conventional rotary die cutting and scoring mechanism as previously discussed. FIG. 9, taken along the line 9-9 in FIG. 1, illustrates a detailed cross-sectional view of the score line 70. As can be seen from FIG. 9, the score line 70 may have the form of an elongated indent 74 pressed into the outer layer 50 from the outer surface 54 thereof. Pressing the indent into the outer layer 50 in this manner results in a corresponding ridge of displaced material 72 being pushed out from the inner surface 52 of the outer layer 50 as shown. Score line 70 may, for example, be formed with a conventional scoring mechanism in which the outer layer 50 material is located between a male scoring knife and a female scoring die such that the scoring knife is located adjacent the outer surface 54 and the scoring die adjacent the opposite inner surface 52. The scoring knife and scoring die are then relatively moved toward one another, causing the scoring knife to press into the outer layer 50, forming the indent 74 and ridge of displaced material 72. The scoring operation may, for example, be performed on a reciprocating scoring machine (i.e., one in which the scoring knife and scoring die move relatively toward one another in a linear fashion while the outer layer material is stationary) or a rotary scoring machine (i.e., one in which the scoring knife and scoring die are mounted on rotating cylinders, and the outer layer material maintains substantially constant motion while the score is formed). Alternatively, the scoring operation may be accomplished with any other type of scoring mechanism.

The width of a score line (e.g., the width "k" of the score line 70 in FIG. 9) will depend, for example, upon the thickness of the material being scored. A typical score line might, for example, have a width of from about 0.0625 inch to about 0.25 inch. The width "k" of the score line 70, FIG. 9, may, for example, lie within this range.

All of the score lines 60 (as well as the other score lines in the outer layer 50) may, for example, be formed in substantially the same manner as described above with respect to the score line 70.

As can be appreciated from FIG. 2, the scored fold lines 60 generally divide the outer layer 50 into a plurality of central panels 110. The plurality of central panels 110 may include a back panel 112, a first side panel 116, a front panel 120, a second side panel 124 and a glue flap panel 128. Back panel 112 terminates at an edge 114 and glue flap panel 128 terminates at an oppositely disposed edge 130. Each of the plurality of central panels 110 may have a length "c" of about 3.875 inches.

Outer layer 50 may further include a plurality of bottom flap panels 140, such as the individual bottom flap panels 142, 146, 150, 154 and a plurality of top flap panels 160, such as the individual top flap panels 162, 166, 170.

Bottom flap panels 140 may be separated from the plurality of central panels 110 via a plurality of scored fold lines 180, such as the individual scored fold lines 182, 184, 186, 188. Scored fold lines 180 may, for example, be co-linear and extend in a direction perpendicular to the scored fold lines 60 previously described. With further reference to FIG. 2, fold line 182 separates the bottom flap panel 142 from the back panel 112; fold line 184 separates the bottom flap panel 146 from the first side panel 116; fold line 186 separates the bottom flap panel 150 from the front panel 120 and the fold line 188 separates the bottom flap panel 154 from the second side panel 124.

Top flap panels 160 may be separated from the plurality of central panels 110 via a plurality of scored fold lines 160, such as the individual scored fold lines 192, 194, 196. Scored fold lines 190 may, for example, be co-linear and extend in a direction perpendicular to the scored fold lines 60 and parallel to the scored fold lines 180, previously described. With further reference to FIG. 2, fold line 192 separates the top flap panel 162 from the back panel 112; fold line 194 separates the top flap panel 166 from the first side panel 116 and the fold line 196 separates the top flap panel 170 from the second side panel 124.

Outer layer 50 may be formed in any conventional manner, for example, by using a conventional rotary die cutting and scoring mechanism. Examples of such rotary die cutting and scoring mechanisms are disclosed in U.S. Pat. Nos. 4,781,371 and 5,757,930, both of which are hereby incorporated by reference for all that is disclosed therein.

After the outer layer 50 is formed, the inner layer 20 may be adhered to the inner surface 52 of the outer layer 50, e.g., by an adhesive, in a manner as will be further described herein in order to complete the manufacture of the carton blank 10, FIG. 1. Referring to FIG. 1, it can be seen that the inner layer 20 may be offset relative to the outer layer 50 such that a portion 115 of the outer layer back panel 112 will not be covered by the inner layer 20 and a portion 34 of the inner layer 20 will overhang the edge 130 of the outer layer 50. As will be discussed in further detail herein, inner layer portion 34 will overlap with a portion 36 adjacent the edge 26 of the inner layer 20 when the carton blank is folded into a carton.

After the outer layer 50 is formed, the inner layer 20 may be added, e.g., by applying an adhesive to the inner surface 52 (FIG. 2) of the outer layer 50, or to the outer surface 24 (FIG. 4) of the inner layer 20 or to both. In this manner, the outer surface 24 of the inner layer 20 will be adhered to the inner surface 52 of the outer layer 50 and, thus, the inner layer 20 will be securely adhered to the outer layer 50. It is noted that, in the case of the exemplary carton blank 10, adhesive generally would not be applied at this stage to the area 115 of the outer layer inner surface 52 since, in this area, the inner layer 20 does not overlap the outer layer 50 (see, e.g., FIG. 1). In a similar manner, adhesive generally would not be applied at this stage to the area 34 of the inner layer outer surface 24 since, as described previously, in the exemplary embodiment illustrated, the inner layer 20 overhangs the outer layer 50 in this area. (again, see, e.g., FIG. 1). Further, adhesive may also be omitted from the area between the inner layer 20 and the plurality of bottom flap panels 140 (e.g. FIG. 2) and the area between the inner layer 20 and the plurality of top flap panels 160, such that the inner layer 20 will not be adhered to the plurality of bottom and top flap panels 140, 160.

The operation of adhering the inner layer 20 to the outer layer 50, as discussed above, may be accomplished in any conventional manner as will be appreciated by one skilled in the art. This operation may, for example, be carried out on a machine of the type well-known in the industry as a "window" or a "window patching" machine. Using such a machine, completed outer layers, such as the outer layer 50 described herein, may individually be fed into the machine. At the same time, material for forming the inner layer 20, typically in continuous roll form, is also fed into the machine. The machine may include an adhesive applicator for applying adhesive, in a manner as described above. The material for forming the inner layer 20 is then cut to the desired length and applied to the outer layer 50 to complete the carton blank 10. The adhesive used may be, for example, a conventional water-borne liquid glue or any other adhesive appropriate for adhering a material such as used for inner layer 20 to a material such as used for the outer layer 50 as will be understood by one skilled in the art.

Figure 3:
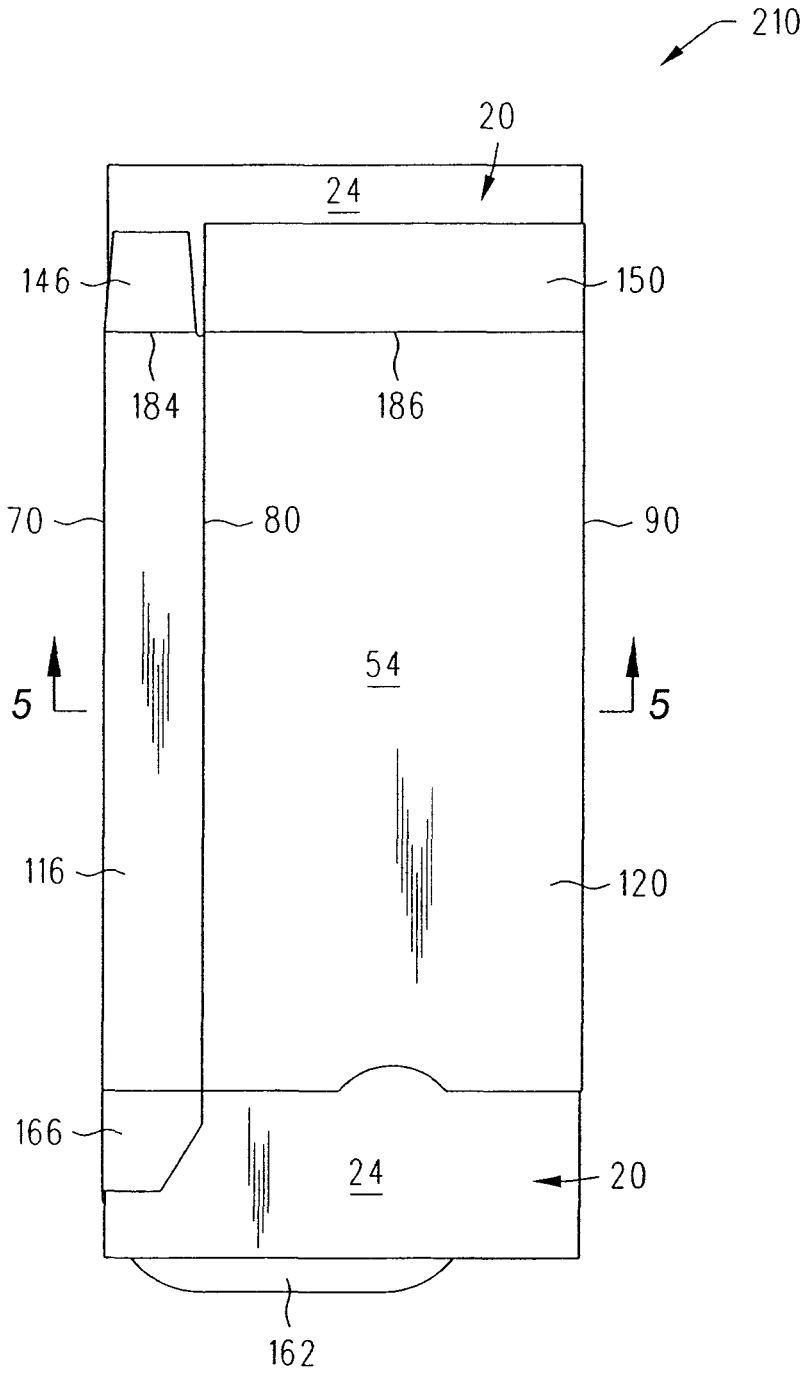
FIG. 3. is a bottom plan view of a knocked-down carton formed from the carton blank of FIG. 1.
Figure 4:
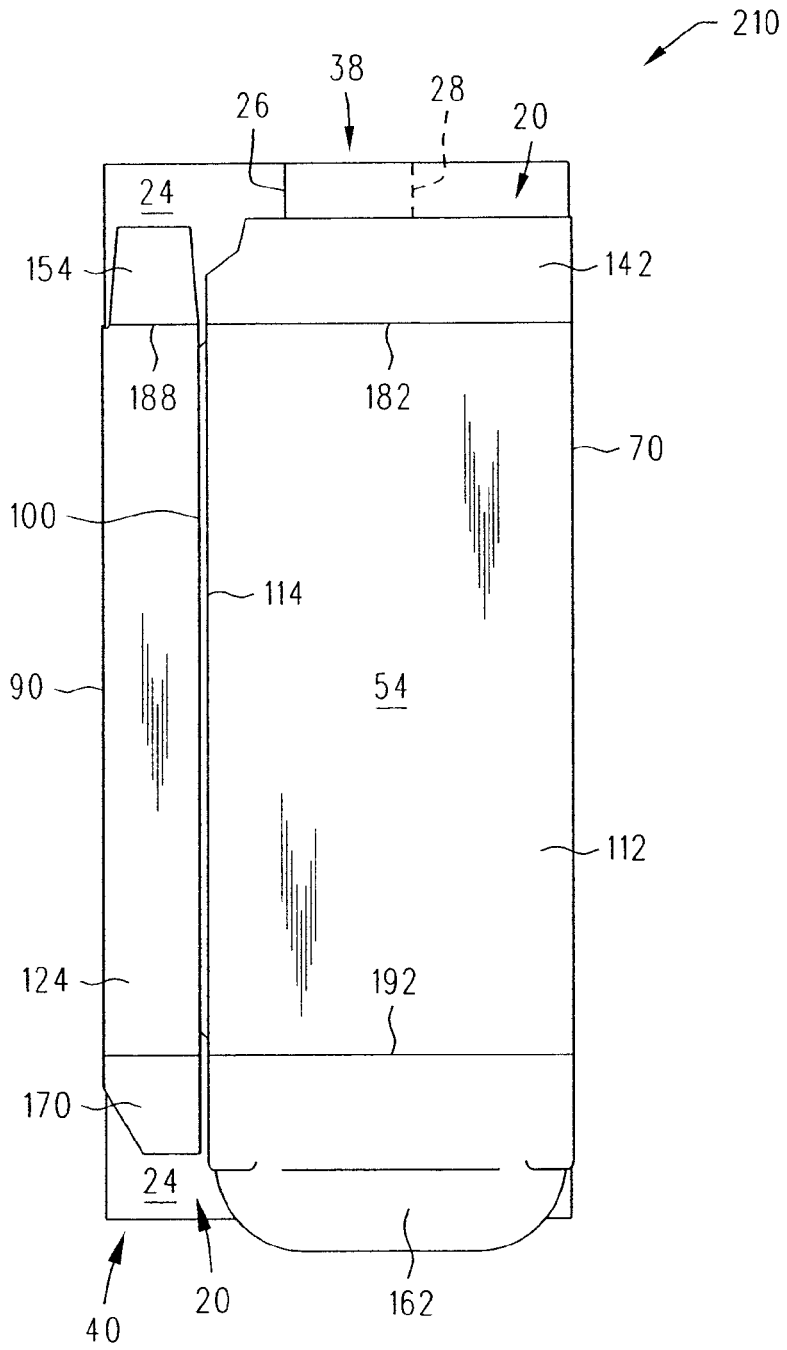
FIG. 4 is a top plan view of the knocked-down carton of FIG. 3.
Figure 5:
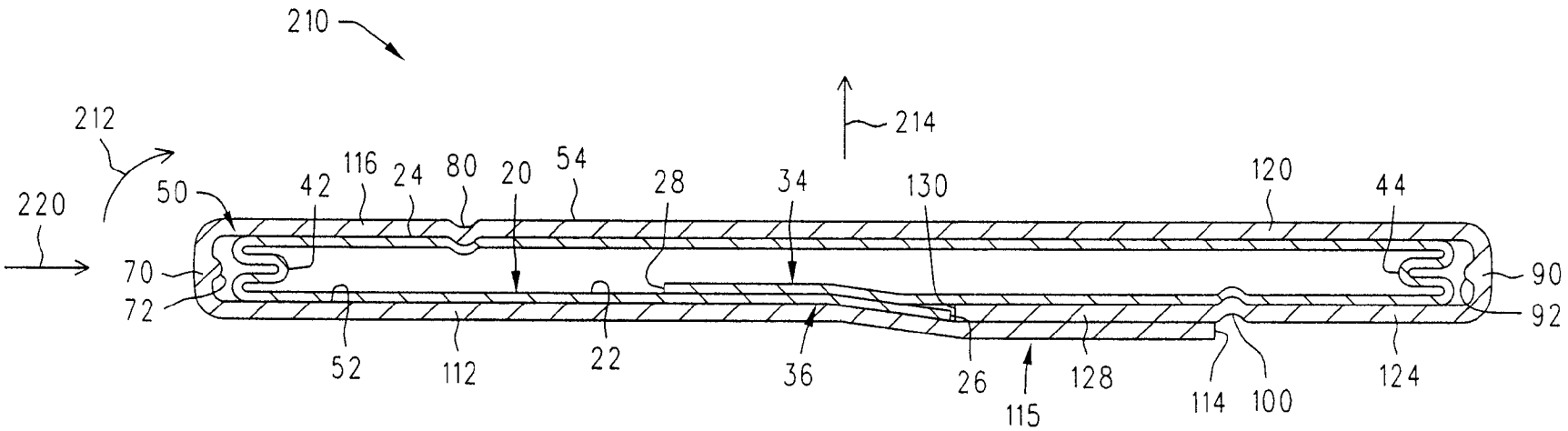
FIG. 5 is a cross-sectional view of the knocked down carton of FIG. 3 taken along the line 5-5 of FIG. 3.

After the carton blank 10 has been formed, in an exemplary manner as described above, the blank is then typically converted into what is commonly referred in the industry as a "knocked-down" carton. An exemplary knocked down carton 210, which has been converted from the carton blank 10, is illustrated in FIGS. 3-5. It is noted that, although the new reference numeral 210 is used to denote the knocked-down carton, features previously described with respect to the carton blank 10 (FIGS. 1-2) are designated with the same reference numerals previously used with respect to FIGS. 1-2.

Comparing FIGS. 1-2 to FIGS. 3-5, to convert the carton blank 10 (FIGS. 1-2) to the knocked-down carton 210 (FIGS. 3-5), the carton blank 10 may first be folded about the score line 90 through an angle of approximately 180 degrees. Specifically, with reference to FIG. 2, the second side panel 124 and glue flap panel 128 may be folded together, as a unit, upwardly (i.e., in a direction out of the page as viewed in FIG. 2) about the score line 90 until the second side panel 124 and glue flap panel 128 are substantially parallel to and overlay the front panel 120. In this condition, as best illustrated in FIG. 5, the portions of the inner layer 20 (FIG. 1) adhered to the second side panel 124 and glue flap panel 128 will be directly adjacent the portion of the inner layer 20 adhered to the front panel 120.

Next, an adhesive (e.g., hot melt glue) may be applied to the outer surface 54 of the glue flap panel 128 (which, as discussed above, has previously been folded as a unit with second side panel 124 about the score line 90) and to the outer surface 24 of the inner layer portion 34 (FIG. 1).

Thereafter, the back panel 112 may be folded upwardly (i.e., in a direction out of the page as viewed in FIG. 2) about the score line 70 through an angle of approximately 180 degrees, causing the back panel 112 to become substantially parallel to the first side panel 116, front panel 120, second side panel 124 and glue flap panel 128. In this condition, as best shown in FIG. 5, the outer layer portion 115 will overlay and, thus, be adhered to the glue flap panel 128 and the portion 36 of inner layer 20 will overlap with and, thus, be adhered to the portion 34 of the inner layer.

Figure 6:
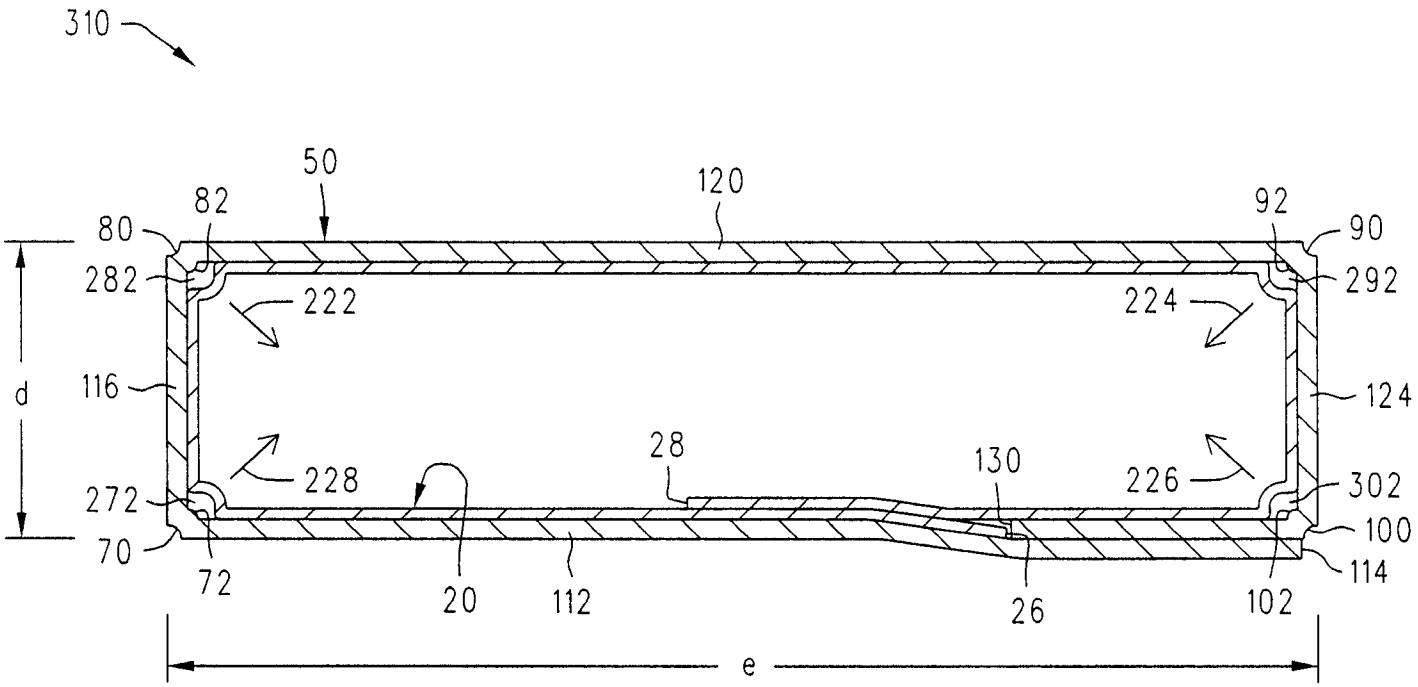
FIG. 6 is a cross-sectional view similar to FIG. 5, but showing the carton after it has been erected.
Figure 10:
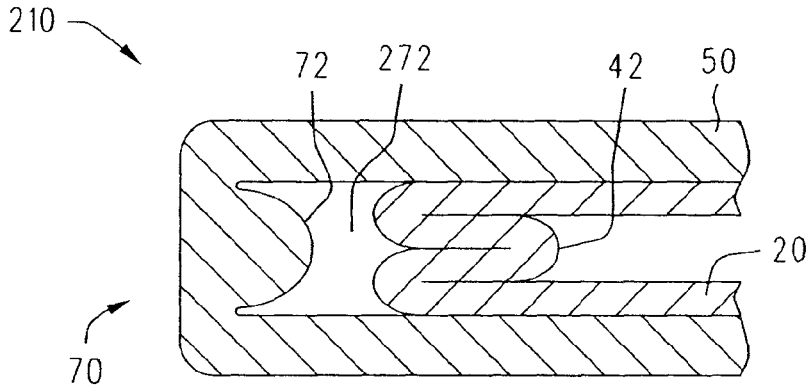
FIG. 10 is a partial cross-sectional view showing, in greater detail, the same score line shown in FIG. 9, but as it appears in the knocked-down carton of FIG. 5.
Figure 11:
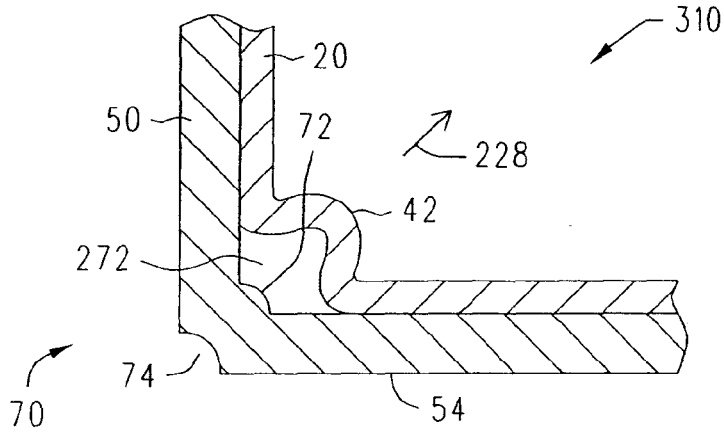
FIG. 11 is a partial cross-sectional view showing, in greater detail, the same score line shown in FIGS. 9 and 10, but as it appears in the erected carton of FIG. 6

FIG. 5 illustrates a cross-sectional view of the knocked-down carton 210 taken along the line 5-5 of FIG. 3. FIG. 6 is a view similar to FIG. 5, but showing the carton after it has been erected, as will be further explained herein. FIG. 9 illustrates a partial cross-sectional view taken along the line 9-9 in FIG. 1 detailing one of the score lines of the carton blank 10. FIG. 10 is a view similar to FIG. 9, but showing the score line after the carton blank 10 has been converted into the knocked-down carton 210 of FIG. 5. FIG. 11 is a view similar to FIGS. 9 and 10, but showing the score line after the knocked-down carton 210 has been converted into the erected carton 310 of FIG. 6.

It is noted that FIGS. 5, 6 and 9-11 are not drawn to scale. Specifically, for example, in FIGS. 5 and 6, the inner layer 20 and outer layer 50 are shown, for illustrative purposes, having exaggerated thicknesses with respect to the dimensions of the overall knocked down carton 210 of FIG. 5 and erected carton 310 of FIG. 6. Further, in FIGS. 5, 6 and 9-11, the illustrated thicknesses of the inner layer 20 and outer layer 50 are not necessarily shown in scale with one another.

With further reference to FIG. 5, it can be appreciated that, to form the knocked-down carton 210, the carton blank 10 has been folded approximately 180 degrees about the score lines 70 and 90 but no folding has occurred about the score lines 80 and 100. Accordingly, the knocked-down carton 210 maintains a substantially flat configuration facilitating storage and/or shipment of knocked-down cartons in a relatively tightly-packed arrangement. With reference to FIG. 4, it can be appreciated that the inner layer 20 will have a bottom portion 38 extending in the area of the plurality of bottom flap panels 140 (FIG. 2) and a top portion 40 extending in the area of the plurality of top flap panels 160 (FIG. 2), as shown.

Conversion of the carton blank 10 into the knocked-down carton 210, as discussed above, may be accomplished in any conventional manner, for example, in a conventional folder-gluer machine as is well-known in the industry.

Knocked-down cartons, such as the exemplary carton 210 discussed above, are typically converted into completed cartons during the filling operation in which product is inserted into the carton for eventual use by consumers. The filling operation may be accomplished by filling equipment as is well known in the industry. In a typical filling operation, for example, a stack of knocked-down cartons may be fed into a filling machine. Generally, the first task performed by the filling machine is to convert the knocked-down carton into an erected carton. An exemplary erected carton 310, which has been converted from the knocked down carton 210, is illustrated in FIG. 6. FIG. 6 shows the same cross-sectional view as FIG. 5 (i.e., taken along the line 5-5 in FIG. 3) except that FIG. 5 illustrates knocked-down carton 210; whereas, FIG. 6 illustrates the erected carton 310. It is noted that, although the new reference numeral 310 is used to denote the erected carton, features previously described with respect to the carton blank 10 (FIGS. 1-2) and the knocked-down carton 210 (FIGS. 3-5) are designated with the same reference numerals previously used with respect to FIGS. 1-5.

With reference to FIG. 6, the erected carton 310 may, for example, have a height "d" of about 0.59375 inch and a width "e" of about 1.96875 inch. As can be appreciated from FIG. 6, the height "d" will be substantially equal to the width of the first and second side panels 116, 124 and the width "e" will be substantially equal to the width of the front and back panels 120, 112 of the outer layer 50.

After the carton is erected (FIG. 6), the bottom portion 38 (FIG. 4) of the inner layer 20 will typically be sealed together and the plurality of bottom flap panels 140 (FIG. 2) will be folded and sealed together by the filling machine such that the outer layer 50 forms a box or carton having a closed bottom end and an open top end and the inner layer 20 now essentially forms a "bag" within the box, the bag being sealed, except for an open top end. Thereafter, the carton may be filled with product through the open top end. The top portion 40 (FIG. 4) of the inner layer 20 may then be folded and sealed together and the plurality of top flap panels 160 (FIG. 2) may be folded and sealed together by the filling machine. In this manner, the inner layer 20 is formed into a fully sealed "bag" containing the product and the outer layer 50 forms a closed box or carton around the bag. As can be appreciated, the filled and sealed carton will have a width substantially equal to the width "e", FIG. 6; a height substantially equal to the height "d", FIG. 6 and a length substantially equal to the length "c", FIG. 2.

As discussed above, a knocked-down carton (e.g., the knocked-down carton 210, FIG. 5) must first be converted into an erected carton (e.g., the erected carton 310, FIG. 6) before it can be filled. With reference to FIG. 5, to perform this conversion, the upper portion of the knocked-down carton 210 is generally pivoted, for example, in the direction indicated by the arrow 212. This pivoting causes the score lines 70 and 90 to move from the approximately 180 degree configuration shown in FIG. 5 to an approximately 90 degree configuration as illustrated in FIG. 6. The pivoting also causes the score lines 80 and 100 to move from the flat, unfolded (approximately zero degrees) configuration shown in FIG. 5 to the approximately 90 degree configuration shown in FIG. 6.

Various mechanisms may be used to force the knocked-down carton 210 into the erected carton 310. Some filling machines, for example, use suction cups to adhere to portions of the back panel 112, the front panel 120 or both, as the knocked-down carton is engaged with the flights of a moving conveyor. A flight of the conveyor then presses against the trailing edge of the carton (i.e., either against the score line 70 or the score line 90, depending upon the orientation of the knocked-down carton). The suction cup, thus, holds the knocked-down carton in a substantially stationary manner, while the conveyor flight presses against the trailing edge. This combination, generally, results in forces 214, 220, FIG. 5, being applied to the knocked-down carton, causing the knocked-down carton to open into the erected carton configuration of FIG. 6. After the carton is erected in this manner, the suction cup generally releases and the erected carton continues to be carried by the conveyor to subsequent stations, e.g., a filling station where product is inserted.

It is noted that the above opening mechanism is described for exemplary purposes only; any other type of opening mechanism or process may alternatively be used. Regardless of the type used, however, all opening mechanisms must overcome the opening resistance inherently displayed by the knocked-down carton being opened. Further, since most filling operations are conducted on high-speed equipment, the opening resistance must be overcome in a relatively short amount of time (e.g., in a small fraction of a second).

In general terms, the opening resistance exhibited by a knocked-down carton can be correlated to the amount of energy required to cause the score lines 70 and 90, to move from the approximately 180 degree configuration shown in FIG. 5 to an approximately 90 degree configuration as illustrated in FIG. 6 and the score lines 80 and 100 to move from the flat, unfolded configuration shown in FIG. 5 to the approximately 90 degree configuration shown in FIG. 6. The energy required, in turn, depends upon several factors. These factors include, for example, the thickness and the composition of the material used to form the outer layer 50.

It has been found that the relative dimensions of the particular carton in question also impact the ability to properly convert the knocked-down carton to the erected carton state; specifically, the ratio of the carton height "d" to the carton width "e" (FIG. 6). It has been found that, in general, the smaller "d" is relative to "e" (in other words, the smaller the ratio "d/e"), the more difficult the carton will be to erect, primarily due to leverage issues.

A problem arises if the opening resistance of a particular knocked-down carton exceeds the capabilities of the machine being used to perform the conversion process. In this case, the knocked-down carton 210 may tend to bow or buckle instead of opening. If this happens, the carton may jam in the machine, disrupting production in an undesirable manner and, possibly causing damage to the machine itself. In the case where suction cups are used, as generally described above, if the opening resistance is too great, this may cause the suction cups to prematurely separate from the carton such that the carton does not open properly; once again, this may result in a jam. As can be appreciated from the above, it is desirable to ensure that the opening resistance of a particular knocked-down carton does not exceed the capabilities of the machine being used to open the carton and it is further desirable, in general, to reduce the opening resistance associated with knocked-down cartons.

Typically, when converting the knocked-down carton 210, FIG. 5, to the erected carton 310, FIG. 6, more energy is required for the fold lines 80 and 100, than for the fold lines 70 and 90. This is because the fold lines 70 and 90 have already been folded once during the formation of the knocked-down carton 210, as explained previously. The outer layer material forming the fold lines 70 and 90, thus, has been weakened to some extent. The fold lines 80 and 100, on the other hand, have never been folded and, thus, tend to exhibit more resistance to folding. One way to reduce opening resistance is to "pre-break" the fold lines 80 and 100. This may be accomplished by either manually or mechanically folding the knocked-down carton about its fold lines prior to introduction into the filling machine. In such a pre-breaking operation, the score lines 80 and 100 may be folded and then returned to their unfolded condition, thus weakening the outer layer material 50 in these areas. The pre-breaking operation, if used, may be performed, for example, in the folder-gluer machine during conversion of the carton blank 10 to the knocked-down carton 210, as described previously. Alternatively, the pre-breaking operation may be carried out in a separate machine or process after the knocked-down carton is formed.

It has also been discovered that using a two-layer carton blank, such as the carton blank 10 disclosed herein, increases opening resistance relative to a single layer structure. With reference to FIGS. 5-6, it can be appreciated that, when a score line, e.g. the score line 70, is folded, the outer surface 54 of the outer layer 50 must elongate relative to the inner surface 52 in the area of the score line. As previously described, a score line, e.g., the score line 70, FIG. 9, results in a ridge of displaced material 72 extending from the inner surface 52. When a score line is later folded, even more material must be displaced, thus, generally causing the ridge of material 72 to enlarge. The energy required to cause this material displacement is the primary contributor to the opening resistance discussed above. With reference, for example, to FIGS. 6 and 9, it can be seen that the outer layer material has deformed such that small amounts of displaced material 72, 82, 92, 102 have been forced into the area of the inner radius of the corners.

Adding an inner layer, such as the inner layer 20 disclosed herein, causes additional material to be located in the area of the score lines. Accordingly, the use of an inner layer generally adds to the opening resistance simply by increasing the amount of material that must be deformed when the blank is folded. Providing an inner layer, however, further compounds the increase in opening resistance due to the fact that the inner layer will be located on the inner radii of the corners described above. Accordingly, the presence of an inner layer will result in additional material that must be displaced into the inner radius of each corner. Because of the limited amount of space in this inner radius area, the additional inner layer material can further add to the opening resistance.

It has been found that the opening resistance of a multilayer carton can be reduced by not adhering the inner layer to the outer layer in the score line areas. With reference, for example, to FIG. 2, non-adhered portions 272, 282, 292, 302, in which the inner layer is not adhered to the outer layer 50, may be provided corresponding to the score lines 70, 80, 90, 100, respectively. FIG. 9 is a cross-sectional view of the score line 70, taken along the line 9-9 in FIG. 2, showing in greater detail the relationship between the score line 70 and the non-adhered portion 272. The non-adhered portions allow the inner layer material to fold inwardly, i.e., in the direction of arrows 222, 224, 226, 228, FIGS. 6 and 11, rather than outwardly following the contour of the outer layer 50. This, in turn, effectively removes the inner layer material from the inner radius of each corner, as described above, and, thus, reduces the amount of material that must be forced into these confined areas.

With reference, for example, to FIG. 6, it can be seen that the inner layer 20 is not adhered to the outer layer 50 in the region of the score lines 70, 80, 90, 100. This allows the inner layer material to fold inwardly, i.e., in the direction of arrows 222, 224, 226, 228, rather than outwardly following the contour of the outer layer 50. This, in turn, effectively removes the inner layer material from the inner radius of each corner, as described above, and, thus, reduces the amount of material that must be forced into these confined areas. FIG. 11 shows the score line 70 of FIG. 6 in further detail.

With reference to FIGS. 1 and 9, in the carton blank 10, a plurality of overlaid score areas 270, 280, 290, 300 may be defined as general areas in which the inner layer 20 overlays the outer layer score lines 70, 80, 90, 100, respectively, FIG. 2. Each overlaid score area may include a non-adhered portion in which the inner layer 20 is not adhered to the outer layer 50 and two adhered portions in which the inner layer 20 is adhered to the outer layer 50. Overlaid score area 270, for example, may include non-adhered portion 272 and adhered portions 274, 276 located on either side thereof. Overlaid score area 280 may include non-adhered portion 282 and adhered portions 284, 286 located on either side thereof. Overlaid score area 290 may include non-adhered portion 292 and adhered portions 294, 296 located on either side thereof. Overlaid score area 300 may include non-adhered portion 302 and adhered portions 304, 306 located on either side thereof.

As can be appreciated with reference, for example, to FIGS. 6 and 11, non-adhered portions 272, 282, 292, 302 result in the inner layer 20 moving inwardly, away from the outer layer score lines 70, 80, 90, 100, as indicated by the arrows 228, 222, 224, 226, respectively. Provision of the non-adhered portions 272, 282, 292, 302, thus, is effective to reduce the overall opening resistance of the knocked-down carton 210, FIG. 5, in a manner as previously discussed.

Referring again to FIG. 1, the adhered portions 274, 284, 294, 304 of the overlaid score areas 270, 280, 290, 300, respectively, may be provided to prevent the inner layer 20 from moving inwardly in the area of the top flap panels 160 as such inward movement of the inner layer 20 in these areas might interfere with proper sealing of the upper portion of the liner after product filling and/or proper closing and sealing of the top flap panels 160 in a manner as previously described. In a similar manner, the adhered portions 276, 286, 296, 306 of the overlaid score areas 270, 280, 290, 300, respectively, may be provided to prevent the inner layer 20 from moving inwardly in the area of the bottom flap panels 140 as such inward movement of the inner layer 20 in these areas might interfere with proper sealing of the lower portion of the liner and/or proper closing and sealing of the bottom flap panels 140 during the filling operation.

Figure 7:
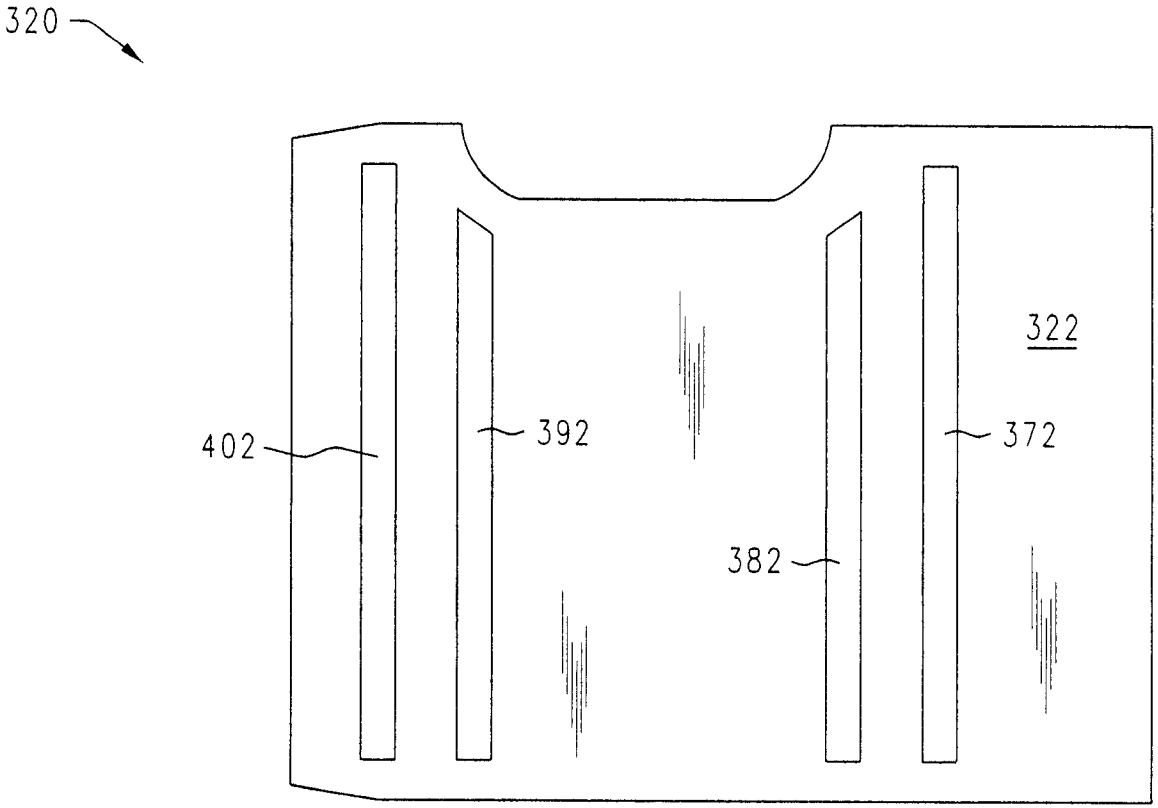
FIG. 7 is top plan view of an adhesive application pad useable in the formation of the carton blank of FIG. 1.

FIG. 7 illustrates an adhesive application pad 320 that may be used to apply adhesive in a pattern to achieve the adhered and non-adhered portions described above. One or more adhesive application pads, such as the pad 320 may, for example, be attached to a cylindrical roller in a conventional manner. In this way, when the pad is rotated through a supply of adhesive and then pressed, for example, against the outer layer 50, adhesive will be applied to the outer layer 50 in a pattern corresponding to the adhesive application pad pattern.

With reference to FIG. 7, adhesive application pad 320 may include a first surface 322 and an oppositely disposed surface, not shown. The oppositely disposed surface may include an adhesive or other attachment mechanism to secure the pad 320 to a cylindrical roller, in a conventional manner. As can be appreciated, the surface 322 will, in effect, act as a printing pad that prints adhesive rather than an ink. Surface 322 may be a continuous surface or may alternatively comprise a pattern, e.g., a cross-hatch pattern. Such patterns are commonly used to control the amount of adhesive applied, as will be understood by one skilled in the art. Adhesive may, for example, be applied to the outer layer 50 at the time that the inner layer 20 is adhered to the outer layer 50. The adhesive application pad 320 may, for example, be used in conjunction with the adhesive application of a "window" or "window patching" machine, as previously described.

With further reference to FIG. 7, adhesive application pad 320 may include a plurality of elongate openings 372, 382, 392, 402, extending through the pad. The openings 372, 382, 392, 402 correspond to the non-adhered portions 272, 282, 292, 302, respectively, described in conjunction with FIG. 1. Accordingly, the adhesive application pad 320 will apply adhesive to the outer layer 50 in a pattern generally corresponding to the surface 322 except for the areas encompassed by the openings 372, 382, 392, 402.

It is noted that, although one exemplary adhesive application device and method has been described, other machines and methods could alternatively be employed to produce the desired adhesive pattern on the outer layer 50 as will be appreciated by one skilled in the art.

Figure 8:
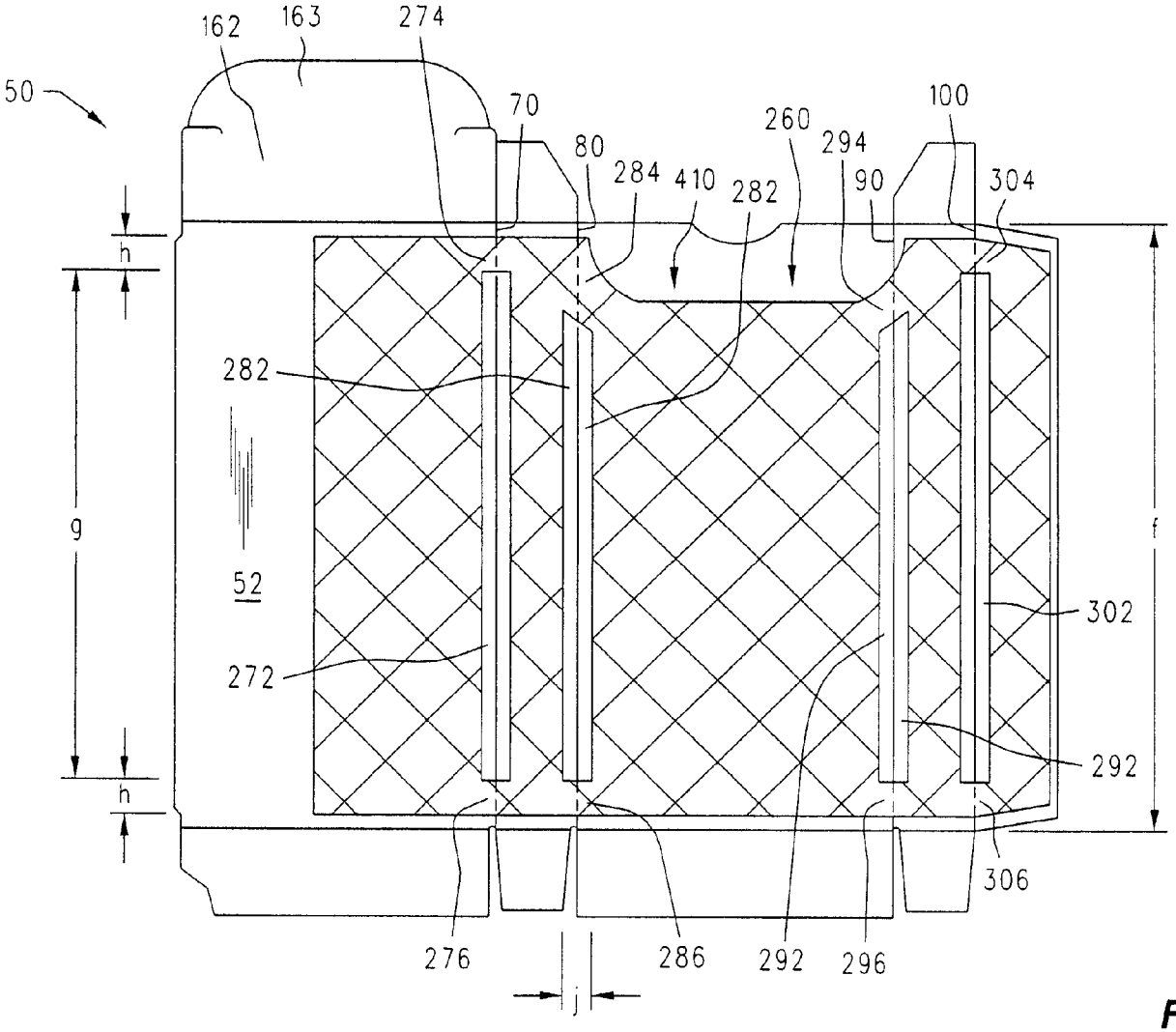
FIG. 8 is a top plan view of a glue pattern applied to the outer layer of FIG. 2 by the adhesive application pad of FIG. 7.

FIG. 8 illustrates the adhesive pattern 410 as it may be applied to the inner surface 52 of the outer layer 50. The same reference numeral convention is used in FIG. 8 as used in FIG. 1 for corresponding features, where appropriate. With reference to FIG. 8, the overlaid score areas 270, 280, 290, and 300, FIG. 2, may, for example, each have a length "f" of about 3.875 inches which, in the present example, is substantially equal to the length of the score lines 70, 80, 90 and 100 and the length "c" of the panels 110. Non-adhered portions 272 and 302 may, for example, each have a length "g" of about 3.125 inches. Adhered portions 274, 276, 304 and 306 may, for example, each have a length "h" of about 0.25 inch. Non-adhered portions 282, 292 may be somewhat shorter than the non-adhered portions 272, 302 in order to accommodate a non-adhered area 260 which, in the present exemplary design, may be provided to facilitate tuck tab portion 163 of the top flap panel 162 when the carton is fully formed. Each of the non-adhered portions 272, 282, 292, 302 may, for example, have a width "j" of about 0.25 inch. The adhesive application pad 320, FIG. 7, may have substantially the same dimensions for corresponding portions of the adhesive pattern 410 of FIG. 8. The openings 372, 382, 392, 402 in the adhesive application pad 320, for example, may have substantially the same dimensions as the non-adhered portions 272, 282, 292, 302, respectively, of the glue pattern 410, FIG. 8.

It is noted, however, that the adhesive pattern 410, FIG. 8, may, in some cases, be slightly larger than the corresponding pattern of the adhesive application pad 320, FIG. 7, due to the propensity of adhesive to spread somewhat beyond the edges of the adhesive application pad 320 during application of the adhesive. Such spread may result, for example, in the non-adhered areas 272, 282, 292, 302, FIG. 8 being slightly smaller than the corresponding adhesive application pad openings 372, 382, 392, 402, respectively. The amount of adhesive spread depends upon several factors, including the viscosity of the adhesive used, the amount of pressure applied during the application process and the elasticity of the material used to form the adhesive application pad 320. Accordingly, it may be desirable, in some cases, to size the adhesive application pad slightly smaller than the desired adhesive pattern.

Another problem sometimes encountered when erecting a knocked-down carton of the general type described herein is that the bottom and top portions 38, 40 (FIG. 4) of the inner layer 20 tend to close due to the partial vacuum formed inside the carton when it is moved from its knocked-down condition to its erected condition. This closing, in turn, prevents air from entering the interior of the carton quickly enough and, thus, may result in a failure condition such as described previously, e.g., jamming of the filling machine. This problem is amplified with higher-speed equipment since, the faster the carton is opened (or attempted to be opened), the greater the vacuum that will be created. It has been discovered that this problem may be alleviated by providing additional "fluff" to the knocked-down carton. The term "fluff", as used herein, refers to the amount of vertical space (as viewed in FIG. 5) occupied by the knocked-down carton. Thus, adding fluff to a knocked-down carton entails folding it less tightly into a generally less flat format. It has been found that such "fluffed" knocked-down cartons tend to exhibit less of the vacuum problem discussed above, since the bottom and top portions 38, 40 of the inner layer 20 will be further apart in a fluffed carton and, thus, less likely to close and prevent air from entering the carton. Knocked-down cartons may be fluffed, for example in the folder-gluer machine described previously.

To maintain fluff, knocked-down cartons may be stored and/or shipped in a less tightly packed configuration than would otherwise be used. As can be appreciated, this less tightly packed configuration will have less tendency to flatten the cartons.

It has also been discovered that the non-adhered score areas described above contribute to the amount of fluff displayed by a knocked-down carton. With reference, for example, to FIGS. 5 and 10, it can be seen that the inner layer 20 will form inwardly-directed folds 42 and 44 adjacent the outer layer score lines 70 and 90, respectively. These folds 42, 44 tend to maintain spacing between the upper and lower portions of the knocked-down carton and, thus, serve to increase and maintain the fluff of the knocked-down carton 210. Due to their shape, the folds 42, 44 may also tend to provide a spring-effect, biasing the upper and lower portions of the knocked-down carton away from one another, thus further increasing fluff.

It is noted that the inner layer 20 is described herein as being substantially rectangular for exemplary purposes only; inner layer 20 could alternatively be any shape or size as desired according to the specific configuration of the carton blank being formed. Further, the specific configuration of the carton blank 10, adhesive pattern 410, etc. have been presented herein for exemplary purposes only. The concepts described herein, e.g., omitting adhesive in the fold line areas, could, of course readily be adapted to virtually any carton blank which is to be folded into a finished carton.

While illustrative and presently preferred embodiments have been described in detail herein, it is to be understood that the inventive concepts may be otherwise variously embodied and employed and that the appended claims are intended to be construed to include such variations except insofar as limited by the prior art.

What is claimed is:

1. A method of making a carton comprising:

providing a first layer of material having at least one first score line therein and at least two second score lines therein, the at least one first score line dividing the first layer into a plurality of central panels and the at least two second score lines respectively separating bottom flap panels and top flap panels from the plurality of central panels;

overlaying a second layer of material over the first layer of material along at least a portion of the at least one first score line to define an overlaid score area;

adhering said second layer of material to a first adhered portion and a second adhered portion of the overlaid score area, but not to a non-adhered portion of the overlaid score area; wherein the first adhered portion is distinct from the second adhered portion; wherein the non-adhered portion is located between the first adhered portion and the second adhered portion along the overlaid score area; wherein the first and second adhered portions are respectively adjacent one of the at least two second score lines; and folding said first layer and said second layer of material about said at least one first score line.

2. The method of claim 1 and further wherein:

said first layer has a first thickness; and said second layer of material has a second thickness less than said first thickness.

3. The method of claim 1 and further wherein said at least one first score line comprises a plurality of score lines.

4. A method of making a carton comprising:

providing a first layer of material having at least one first score line and at least two second score lines therein, the at least one first score line dividing the first layer into a plurality of central panels and the at least two second score lines respectively separating bottom flap panels and top flap panels from the plurality of central panels;

disposing a second layer of material over said first layer of material and over the entirety of the at least one first score line to define an overlaid score area in which the second layer of material overlays the at least one first score line of the first layer of material; and adhering the second layer of material to a first adhered portion and a second adhered portion of the overlaid score area, but not to a non-adhered portion of the overlaid score area; wherein the first adhered portion is distinct from the second adhered portion, wherein the non-adhered portion is located between the first adhered portion and the second adhered portion along the overlaid score area, and wherein the first and second adhered portions are respectively adjacent one of the at least two second score lines.

5. The method of claim 4 further comprising:

folding said first layer and said second layer of material about said at least one first score line.

6. A combination carton blank comprising:

a first layer of material having a plurality of panels separated by at least one first score line and at least two second score lines; the at least one first score line dividing the first layer into a plurality of central panels and the at least two second score lines respectively separating bottom flap panels and top flap panels from the plurality of central panels;

a second layer of material overlying at least a portion of the first layer of material, thereby defining an overlaid score area in which the second layer of material overlays the at least one first score line of the first layer of material;

the second layer of material being adhered to a first portion and a second portion of the at least one first score line and not adhered to a third portion of the at least one first score line;

wherein the third portion is located between the first portion and the second portion along a length of the at least one first score line, and wherein the first portion and the second portion are respectively adjacent one of the at least one second score lines.

* * * * *